United States Patent [19]

Wilts et al.

[11] Patent Number: 4,956,825

[45] Date of Patent: Sep. 11, 1990

[54] DEVICE FOR MONITORING THE RATE OF USE OF AN ELECTRICAL APPLIANCE

[76] Inventors: Charles H. Wilts, 11982 Pomerado Rd.; Michael T. Burke, 14132 Rio Court Rd., both of Poway, Calif. 92062; David W. Thygeson, 4727 Otomi Ave., San Diego, Calif. 92117

[21] Appl. No.: 475,164

[22] Filed: Feb. 5, 1990

[51] Int. Cl.[5] ..... G04F 8/00

[52] U.S. Cl. ..... 368/9; 368/10; 368/113

[58] Field of Search ..... 368/3, 5, 6, 9, 10, 368/107–113; 340/309.15, 309.14; 364/509

[56] References Cited

U.S. PATENT DOCUMENTS 4,502,788 3/1985 Lowden ..... 368/110
4,518,267 5/1985 Hepp ..... 368/107
4,630,292 12/1986 Juricich et al. ..... 368/5
4,640,624 2/1987 Pitt ..... 368/111
4,652,139 3/1987 Suller et al. ..... 368/9

*Primary Examiner*—Vit W. Miska
*Attorney, Agent, or Firm*—Ralph S. Branscomb

[57] ABSTRACT

A usage monitor is provided for electrical appliances, primarily for televisions, which keeps track of appliance usage during a moving time interval, such as the week immediately prior to the instant moment, and provides a readout of a number of hours per unit time that the device has been on. In the television implementation illustrated and claimed, a power interfacing box is used into which the television plug is inserted, and the box has a key-operated switch which enables the time monitoring to be temporarily deactivated in the event the parents wish to watch some television.

9 Claims, 3 Drawing Sheets

DEVICE FOR MONITORING THE RATE OF USE OF AN ELECTRICAL APPLIANCE

BACKGROUND OF THE INVENTION

The invention relates to time measuring devices and more particularly to time measuring devices for use in monitoring the intensity of usage of electrically-operated appliances, such as televisions and telephones.

The regulation of children's television watching time is gaining importance as parents, educators, sociologists and other experts in the field of human behavior become more cognizant of the effects of excessive viewing on both academic performance and social behavior. Two types of devices, elapsed time indicators and television regulators, have been used or proposed for use by parents who wish to control the amount of time per day or per week their children watch television. Parents in many households also desire to limit and monitor the amount of time a child spends on the telephone. Children, especially teenagers, tend to monopolize the telephone, thereby tying up a two-way communication device which is blocked from incoming calls, as well as inhibiting the ability to call out.

There is presently a need for operators of powered equipment to have the capability of monitoring the rate of usage of said equipment. The applications for such a device have infinite possibilities. For example, in the case of industrial machinery, allocating costs to users, increasing operator productivity, and scheduling preventative maintenance. In the case of household appliances, the purpose for monitoring has been primarily to regulate the amount of use of an appliance, such as a television. These needs have spawned the development of two types of devices, the first of which records total elapsed operating time and the second of which restricts the available operating time of an electrically operated appliance.

A variety of electromechanical and electronic devices have been described which automatically monitor and record the total elapsed operating time of mechanical or electrical equipment, thus eliminating the requirement to manually record start and stop times and calculate accumulated time of use. A number of such devices measure and record the accumulated operating time of particular classes of industrial equipment, such as trolley cars, as described in Arthur, U.S. Pat. No. 1,458,509, large electrical motors, as described in Johnson, et al, U.S. Pat. No. 1,475,831, and automatic data processing equipment, as described in Mackay, et al, U.S. Pat. No. 3,221,489. Other devices, such as that described in Wilder, U.S. Pat. No. 464,540, and numerous variations thereof, have broader application, being capable of measuring and recording the accumulated operating time of virtually any electrically operated equipment or household appliance.

All of the above-cited devices accumulate total elapsed operating time of the equipment in question. For purposes of regulating appliance usage, these devices share the major disadvantage that they do not have the capability of registering or displaying the intensity of use, i.e., the amount of actual use per given time interval. For example, if a parent wants to know the number of hours per week a television is being watched, additional time records must be kept and separate calculations computed manually.

A number of devices have been proposed, especially to regulate the operating time of appliances, and more specifically, televisions. These devices limit the total available use time or restrict the specific hours of permissible use, or both. Noiles, U.S. Pat. No. 3,581,029 describes a TV On Time Control, based on a countdown timer which is set using a control contained within a lockable case. Once set, the timer deducts time from the set amount whenever the television is operating. Leone, U.S. Pat. No. 3,833,779 describes a Television Timer to Regulate Television Viewing Time, which includes a countdown timer similar to that described by Noiles, but which deducts time whether or not the television is operating. Pressman, U.S. Pat. No. 4,246,495 describes a Television Monitor and Control, a timer similar to that described by Noiles, but which also restricts television viewing to certain pre-selectable times of the day. Maclay, U.S. Pat. No. 4,588,901 describes a Timer Control for Television, a timer similar to that described by Leone, but which also displays the amount of remaining available operating time and which includes a key operated switch to disable the subtraction of time when the parents are watching alone. Each of these devices uses a case with lock and key to restrict access to the setting and resetting controls. Each device also includes a means of retaining the television's power cord within the locked case and a means to control the supply of electrical power to the television. When the respective viewing limits are exceeded, the power to the television is switched off by the device, thereby disabling the television until the controls are reset. The only information displayed by these devices is the remaining available operating time, which, in the case of the devices described by Pressman and Leone, is visible only when the case is unlocked. None of these devices monitors or displays the rate of actual appliance usage, for example, the number of hours per week the television has actually been operated. Leone's device requires manual resetting of the countdown timer when it runs down. The other three television regulating devices automatically reset the timer at the expiration of successive fixed time periods. All of the television regulating devices require the timing controls to be set initially by the parent.

A major disadvantage shared by all of the previously described prior art, both television regulating devices and elapsed time indicators, is that they do not inform the parents as to the actual rate of usage of the television. This is a severe disadvantage for parents of preschool age children who are most likely to be impacted by the negative effects of excessive television viewing. The onus is upon the parents to make instantaneous viewing decisions for this age group in view of the complexity inherent in the above-described devices and the unlikelihood that the instant age group could understand the restrictions. In order for parents to monitor compliance with weekly viewing guidelines, to reinforce good viewing habits, and to ascertain both desirable and undesirable trends, the parents would have to maintain additional records and further manually calculate viewing hours per day, week, or any designated interval.

A further disadvantage of the aforementioned prior art television regulating devices is that they require the parent to set, and in some cases, periodically reset, the timers which control viewing. This requirement, in view of its complexity, makes the equipment more difficult to operate; it creates the need for numerous switches, dials, and other controls, which significantly increases the costs to manufacture these devices. Multiple controls also decrease the reliability of the devices, since switches and dials have high failure rates relative to other electronic components.

A major disadvantage of the prior art television regulating devices is that they regulate the appliance's use time by automatically shutting off power to the appliance. Many modern and sophisticated television sets have solid state digital memories containing, for example, clock time and option selections set by the user, and shutting off the power to the television can cause this data to be erased. Furthermore, all of these regulating devices use locks and keys to restrict access to the setting and resetting controls. This fact, coupled with an automatic shut-off mechanism, can cause an extended and frustrating interruption in a television program if for some reason the key is not readily accessible at the time the television is disabled.

The above stated disadvantages of both elapsed time indicators and television regulators also relate to monitoring the usage rate of telephones. As none of these devices monitor and display the rate of usage, they also necessitate setting and resetting controls, are inconvenient to operate and interpret, are expensive to manufacture, and are not as reliable as other electronic components. The prior art television regulating devices, in particular, because they regulate usage by disabling the regulated appliance, would be unacceptable for monitoring telephones, a the conversation could be interrupted and incoming calls blocked.

SUMMARY OF THE INVENTION

The present invention overcomes the disadvantages of the prior art in that it provides a device for continuously monitoring and reporting the usage rate, inter alia, number of hours per week of an electrically operated appliance, for purposes of enabling parental regulation of the amount of usage of the appliance. Yet a further advantage lies in the instant invention's capability of monitoring, and thereby regulating, an appliance's usage rate without interfering with operation of the appliance by switching off its power.

The device further comprises a substantial improvement over the prior art in that it is capable of continuously monitoring and reporting the usage rate and thereby obviates the necessity of setting or resetting the timer controls to effect operation. The simplicity of this device renders a cost-effective item of manufacture and improved reliability.

Yet another improvement is the capability of the device to monitor television usage rate, without actually restricting television usage. This feature has special significance in the sociological/psychological forum in view of its capacity to quantify observation trends among young audiences who are impacted by viewing frequency. This data is extremely useful on many levels, not to mention the immediacy of the home environment where parents can readily make decisions based upon the data at hand.

The device is also capable of monitoring the usage rate, such as hours per day, of a telephone, without interfering with operation of the telephone or precluding reception of incoming calls.

DESCRIPTION OF THE PREFERRED EMBODIMENT OF THE INVENTION

Figure 1:
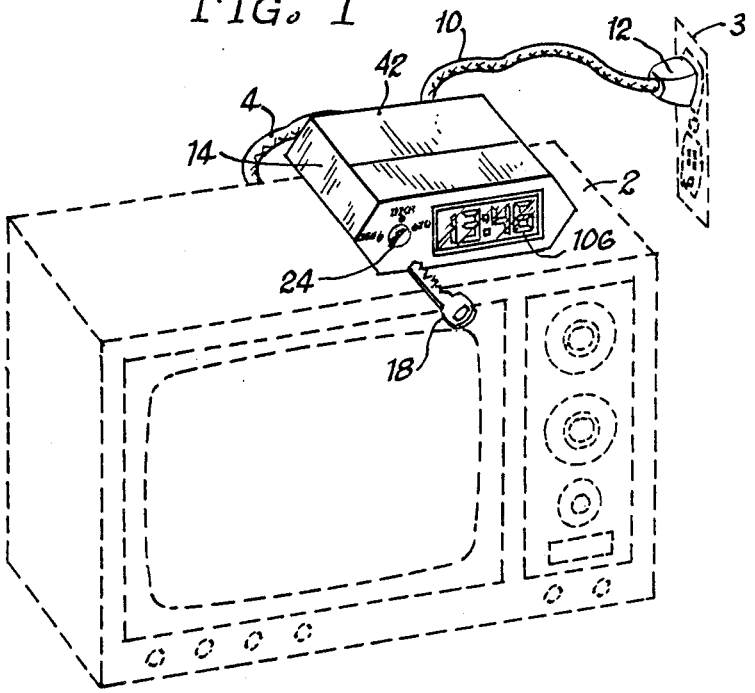
FIG. 1 is a perspective view showing the usage rate monitor embodied in a self-contained device for monitoring television viewing time.
Figure 2:
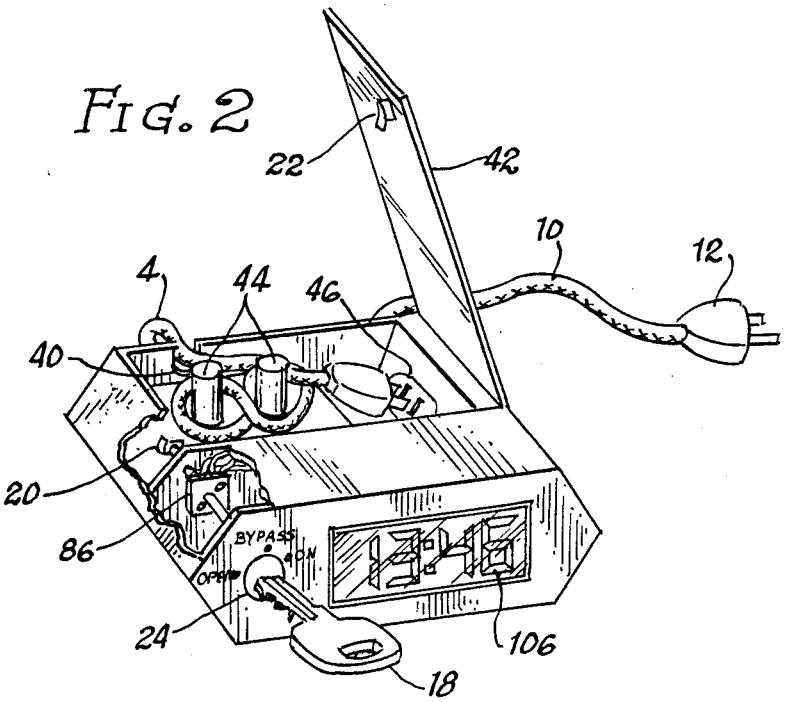
FIG. 2 is a perspective view showing the internal arrangement of the device of FIG. 1.

FIGS. 1 and 2 show the overall structure and internal arrangement of one embodiment of the proposed device, a self-contained television usage monitor. The television usage monitor consists of a case 14, a numerical display 106, a television power cord retainer 44, an internal power receptacle 46, and a power cord 10 with a connector 12. The case 14 has a lock 24, operated by a key 18, which alternatively prevents and enables the opening of the access door 42 by causing the hook 20 to engage and disengage with the latch 22 on the access door 42. The lock 24 is combined with a switch 86, which deactivates the television monitoring function when the parents are watching television alone. The case 14 further includes a notch 40 through which the television's power cord 4 can be routed to the inside of the case 14. The self-contained usage rate monitor can be placed on top of the television 2 and connected to an available power receptacle 3.

Figure 3:
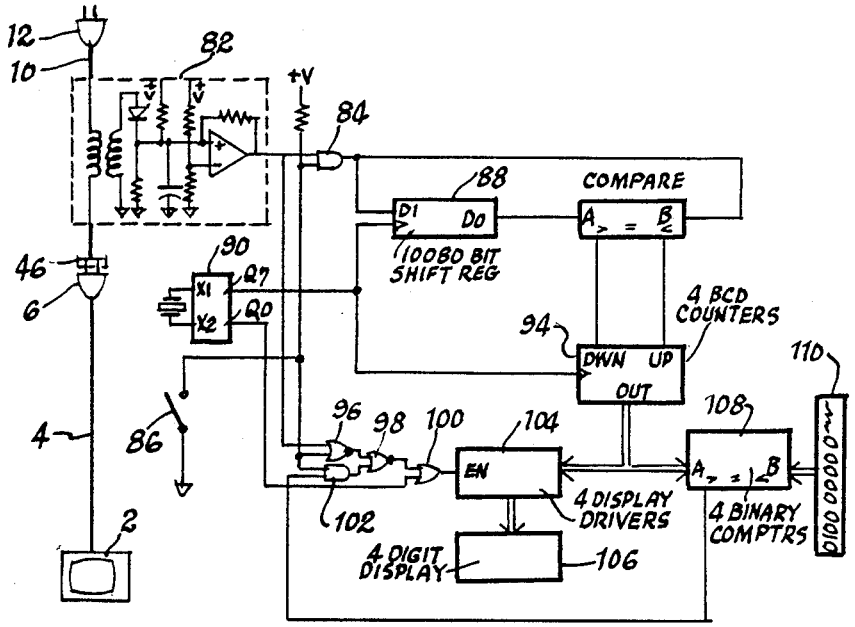
FIG. 3 is a circuit block diagram showing the internal electronic components of the device of FIG. 1.

FIG. 3 shows the internal electronic components of the television usage rate monitor. The internal power receptacle 46 provides power to the television 2 via the television's power cord 4 and connector 6. Other internal components are a current sensor 82, AND gates 84 and 102, NOR gates 96 and 98, OR gate 100, clock circuit 90, shift register circuit 88, comparator circuit 72, four BCD counters 94, four display drivers 104, four binary comparators 108 and a read-only memory circuit 110. Also shown for clarity are the four-digit display 106, the key switch 86 and the device's power cord 10 with connector 12.

When monitoring of the television is desired, the television 2 is plugged into the power receptacle 46 interior to the television usage monitor's case 14, the television power cord 4 is routed through the notch 40 and engaged in the power cord retainer 44, the access door 42 is locked using the lock 24; the switch 86 is placed in the ON position, the key 18 is then withdrawn, and the television usage monitor is plugged in to an available power receptacle 3. Thereafter, as explained in detail below, the television usage monitor will register the times during which the television is being operated and will continually display the number of hours and minutes of television operation during the preceding week. Whenever the accumulated operating time has exceeded a certain limit, which in the illustrated embodiment is preset to twenty hours, the display 106 flashes as explained later. The flashing display thus indicates a warning that television viewing has been excessive and that an assessment of the situation may be appropriate.

If the parents wish to view television alone without including their viewing time in the displayed amount, the key 18 is reinserted and the lock 24 can then be placed in the BYPASS position. As explained below, the television usage monitor will then function as if the television is turned off, regardless of the actual state of the television. As a security measure, the lock 24 blocks the removal of the key 18 except when the lock 24 is in the ON position, so as to preclude accidentally leaving the device in the BYPASS mode of operation. As a further security measure, the display 106 flashes, as explained below, whenever the lock 24 is in the BYPASS position and the television is turned off. This feature helps to preclude the parent from accidentally leaving the key in the device after the parent is finished viewing the television.

FIG. 3 illustrates the above functions and their implementation in the described and claimed embodiment. When the lock 24 is in the ON position, the switch 86 is open. Therefore, the input from the switch 86 to AND gate 84 is HIGH. The current sensor 82 detects whether the television is operating and, if so, causes the second input to AND gate 84 to be HIGH. Thus, if the television is operating while the lock 24 is in the ON position, the output from AND gate 84 is HIGH. The output from AND gate 84 is input to both the shift register circuit 88 and the comparator circuit 92, as will be described. The clock circuit 90 produces two square wave outputs, Q7 and Q8, with periods of one minute and approximately one-half second, respectively. Once per minute, when the Q7 output transitions to HIGH, the output of AND gate 84 is stored in the 10,080-bit shift register circuit 88. If the lock 24 is in the ON position and the television is operating, a HIGH level is stored. Otherwise, a LOW level is stored. Thus, assuming the lock 24 is in the ON position, the shift register circuit 88 contains a record, taken at one-minute intervals, of when the television was operating over the previous 10,080 minutes, which equals seven days. For those periods when lock 24 is in the BYPASS position, the shift register circuit 88 will reflect the same as if the television were off.

Output DO of the shift register circuit 88 is the contents of the oldest bit, which reflects the status of the television and the lock 24 exactly one week prior to the present time. The output of the compare circuit 92 is input to the four BCD counters 94, which are enabled once per minute by the Q7 output of clock circuit 90. Thus, once per minute the four BCD counters 94 are either incremented, if the present level is HIGH and the level one week ago was LOW; decremented if the present level is LOW and the condition one week ago was HIGH; or unaffected if the present level is the same as the level one week ago.

Inasmuch as the shift register began loaded with zero's, this provides a "rolling window" of usage during the last week. Therefore, the four BCD counters 94 register the total number of minutes during the preceding one week that the television was on while the lock was in the ON position. The four BCD counters 94 are chained together such that they represent the most-through-least significant digits of time expressed as hours and minutes.

The outputs of the four BCD counters 94 are the inputs to the four display drivers 104, which in turn drive the four-digit display 106. The output of OR gate 100 is an enabling input to the display drivers 104 which causes the four-digit display to flash under either of two conditions as described and explained herein. The four binary comparators 108 compare the outputs of the four BCD counters 94 with the fixed contents of the read-only memory circuit 110, which is preset to twenty hours in the illustrated embodiment. When the outputs of the four BCD counters 94 are greater than the contents of read-only memory 110, the output of the comparators is HIGH. If concurrently the lock 24 is in the ON position, then both inputs to AND gate 102 will be HIGH, and the output of AND gate 102 will thus be HIGH. Therefore, the output of NOR gate 98 will be LOW, which in turn will cause the output of OR gate 100 to oscillate with output Q0 of clock circuit 90. Since the output of OR gate 100 is the enabling input to the display 106, the result is that the display 106 will flash approximately twice per second whenever twenty hours of television operating time has been exceeded during the week and the lock 24 is in the ON position. Similarly, if the lock 24 is in the BYPASS position while the television is off, then both of the inputs to NOR gate 96 will be LOW, causing the output of NOR gate 96 to be HIGH; therefore, the input to NOR gate 98 will be HIGH, causing the output of NOR gate 98 to be LOW, thereby causing the display 106 to flash as explained above. Thus, the display 106 will also flash whenever the lock 24 is in the BYPASS position while the television is turned off.

Figure 4:
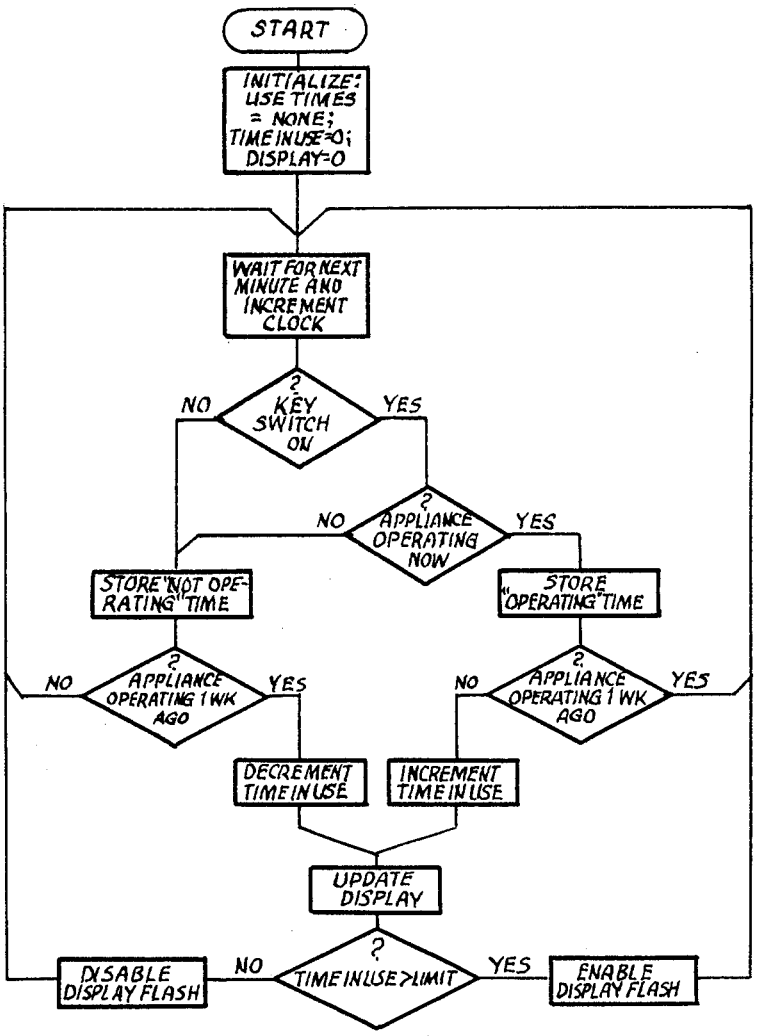
FIG. 4 is a flow diagram showing a preferred method of tabulating appliance usage and calculating the usage rate in hours per week.

FIG. 4 further illustrates and explains the functions performed by the shift register circuit 88, comparator circuit 92, counters 94, comparators 108 and read only memory 110 shown in FIG. 3 and described above.

As will be obvious to those skilled in the art, commercially available technology provides several design approaches alternative to that illustrated in the figures and described herein. For example, the record of television operating times could be maintained by recording start and stop times in a random access memory. Furthermore, many of the functions described could be incorporated into a microprocessor or a custom-designed microcircuit. There are also variations on the one-week time interval of interest as well as the twenty-hour warning threshold. Other such times could be preset into the device or, in still another embodiment, these times could be made selectable by the parent. As an alternative to the stand-alone device the television usage monitor could be incorporated into the design of the television set itself. In still another embodiment, for monitoring the usage rate of a telephone, the device could attach to and plug into a standard telephone receptacle and electrically sense an off-hook condition to determine that the telephone is in use.

I claim:

1. A use monitor for an electrical appliance for providing a continuous report of appliance use time during a specific moving time interval immediately prior to the report, said monitor comprising:

(a) a sensor for detecting when said appliance is in use;

(b) a register operatively connected to said sensor which records a continuous pulse train indicative of sequential periods of use or non-use of said appliance over said time interval;

(c) counter means for counting the periods of use represented by said pulse train; and, (d) utilization means connected to said counter means for utilizing the results therefrom.

2. Structure according to claim 1 wherein said counter means comprises:

(a) a comparator which compares whether the present momentary use of the appliance is (1) more than, (2) equal to, or (3) less than the use exactly one time interval ago; and, (b) a counting device operatively connected to said comparator which increments, remains the same, or decrements, as said comparator indicates states (1), (2) or (3), as indicated above, respectively; and, said utilization means comprises read-out means indicating to the user the present number in the counter means.

3. A use monitor according to claim 2 and including a user-operated override means to cause said pulse train to indicate only periods of non-use when said override means is actuated.

4. A use monitor according to claim 3 wherein said disabling means is a key-lock operated switch.

5. A use monitor according to claim 2 and including a micro-encoded pre-set number standard and a secondary comparator means which compares current usage rate to said number standard and if concurrent usage rate exceeds said number standard, triggering an indicator.

6. A usage monitor according to claim 5 wherein said read-out means is a visual display and said indicator comprises a blinking superimposed on said visual display.

7. A usage monitor according to claim 2 wherein said sensor is a current sensor operatively connected to the main power lines of said appliance.

8. A usage monitor according to claim 2 and including a lock box with an outlet for said appliance connected to a power cord, said box containing said sensor, register, comparator means, and read-out means.

9. A use monitor for an electrical appliance for providing a continuous report of appliance use time during a specific moving time interval immediately prior to the report, said monitor comprising:

(a) a sensor for detecting when said appliance is in use and producing a pulse representing a pre-set time interval for each of said time intervals in which said appliance is in use;

(b) a timer means which detects and signals the passing of successive fixed time periods;

(c) a counting device operatively connected to said timer means which, when signalled by said timer means that one of said successive fixed time periods has passed, counts the number of pulses in said passed succesive fixed time period; and, (d) read-out means indicating to the user a number which is a function of the present number of pulses in said counting device.

* * * * *